United States Patent [19]

Bierlich

[11] 4,073,224

[45] Feb. 14, 1978

[54] VENTILATORS

[76] Inventor: Johannes Harald Bierlich, Charlottenlund, Denmark

[21] Appl. No.: 703,294

[22] Filed: July 7, 1976

[51] Int. Cl.[2] ..... F24F 7/00

[52] U.S. Cl. ..... 98/41 R; 98/97; 137/614.11

[58] Field of Search ..... 98/96, 98, 37, 41 R, 98/88 R, 93, 97; 49/73, 109, 110, 111, 112, 114; 137/614.11; 52/586; 74/25

[56] References Cited

U.S. PATENT DOCUMENTS

| | | | |
|---|---|---|---|
| 418,193 | 12/1889 | Kolzem | 98/96 |
| 821,510 | 5/1906 | Knox | 49/98 |
| 2,456,340 | 12/1948 | Tideman | 98/96 |
| 3,275,031 | 8/1966 | Alyea et al. | 98/41 R |
| 3,320,869 | 5/1967 | Schach | 98/40 D |
| 3,411,254 | 11/1968 | Kessler | 52/586 |
| 3,433,295 | 3/1969 | Avery | 98/33 R |
| 3,584,413 | 6/1971 | Abrami | 49/114 |
| 3,785,272 | 1/1974 | McNabney et al. | 98/40 D |
| 3,811,369 | 5/1974 | Ruegg | 98/40 D |

FOREIGN PATENT DOCUMENTS

| | | | |
|---|---|---|---|
| 80,297 | 12/1953 | Denmark | 98/41 R |
| 1,191,091 | 4/1965 | Germany | 98/41 |
| 1,309,106 | 3/1973 | United Kingdom | 98/41 |

*Primary Examiner*—William E. Wayner
*Attorney, Agent, or Firm*—Brisebois & Kruger

[57] ABSTRACT

A ventilator comprises upper and lower bars spaced apart by spacer members to provide a ventilation aperture, and a pair of flaps hinged to respective ones of said upper and lower bars by operating means which when operated in one direction causes the flaps to close the opposite sides of said ventilation aperture and when operated in the opposite direction causes the flaps to open the respective opposite sides of the said aperture.

9 Claims, 3 Drawing Figures

Fig.1
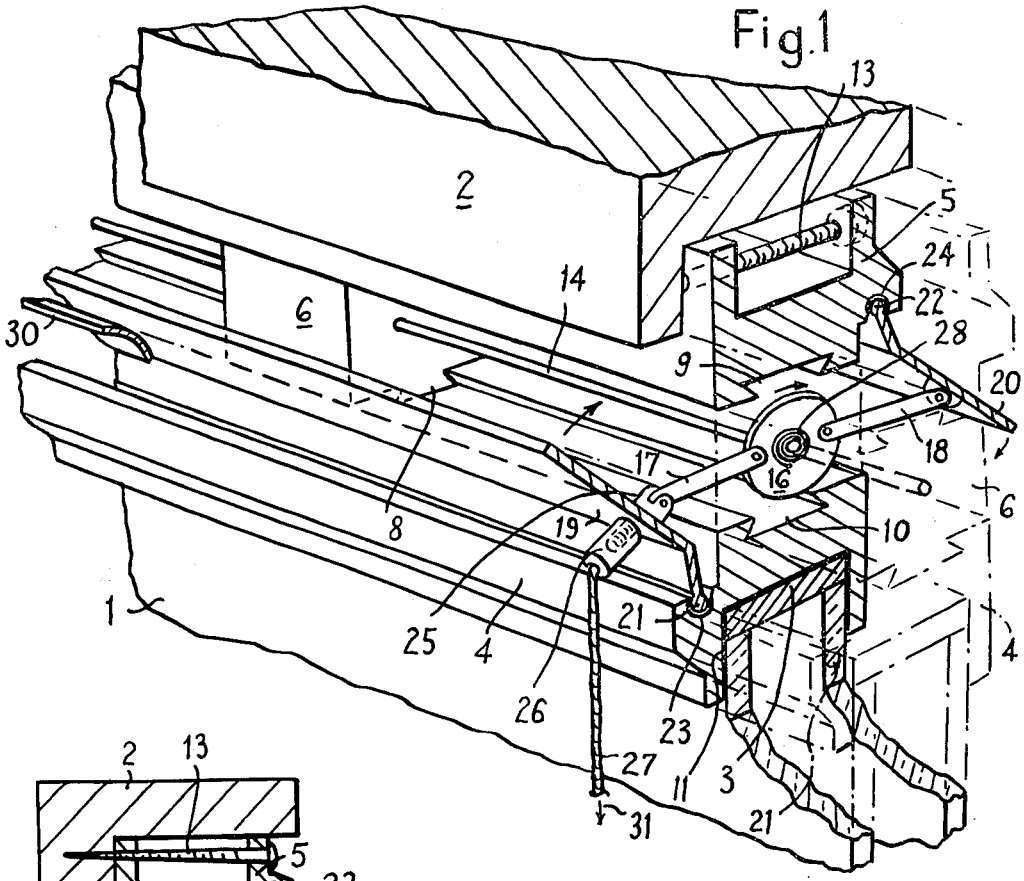
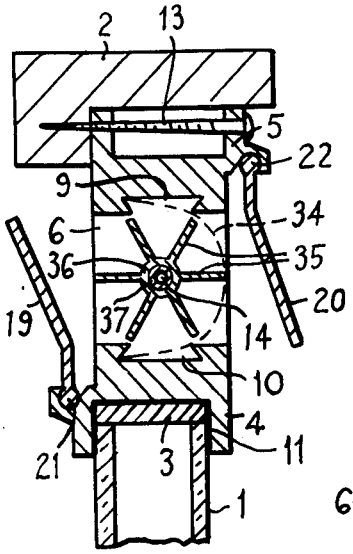
Fig.3
Fig.2
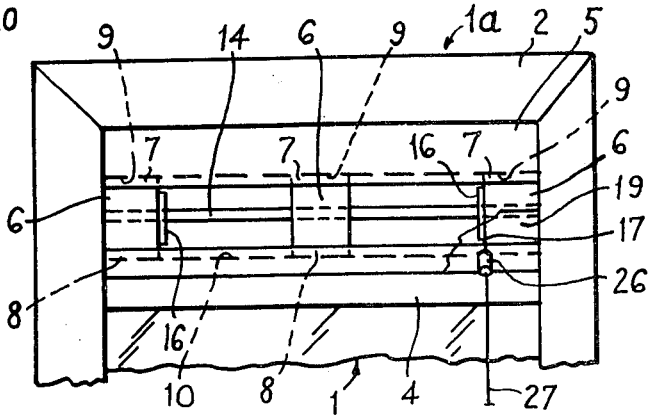

VENTILATORS

This invention relates to ventilators and it has particular, though not exclusive, application to ventilators for use in windows. Ventilators of this type are disclosed in British patent specification Nos. 1,309,106 and 1,377,387.

It is frequently necessary to provide ventilation in a room at a point near to the top of the room only particularly in double-glazed windows.

An object of the present invention is to provide a ventilator, primarily for windows, which can be assembled quickly in a reliable and simple manner, using a minimum of component parts and which presents a neat appearance, particularly on the inside.

To this end, the invention consists in a ventilator, primarily intended to be mounted within a window sash between the upper rail of the sash and the upper edge of glazing in the sash, said ventilator including upper and lower bars spaced apart by and connected to each other by spacer members to provide a ventilation aperture, and a pair of flaps hinged to respective ones of said upper and lower bars and operatively coupled together by means of an operating member, wherein operation of the member causes the flaps to rotate about their hinge points, operation of the member in one direction causing the flaps to close the respective opposite sides of the aperture in the ventilator and operation of the member in the opposite direction causing the flaps to open the respective opposite sides of the aperture. By means of the pair of flaps a neat appearance is obtained both on the inside and outside of the ventilator and effective ventilation.

Moreover, since the upper and lower bars, flaps and spacer members may easily be cut to any desired length, or the spacer members easily made as cast blocks, a structure, which can be made to fit openings of a variety of lengths and heights, can easily be made from a limited number of basic parts and there is no need for a user or supplier to stock ready made ventilators in a number of different sizes.

Furthermore, the upper and lower bars can easily be adapted for example in an extrusion operation to fit against the upper rail of a window sash and the upper edge of glazing in the sash so that the ventilator can be mounted within the window sash between the upper edge of the glazing in the sash and the upper rail of the sash and to extend substantially for the full width of the glazing. Thus, the ventilator can be simply and easily assembled when the window is being glazed and provides a good mechanical connection between the upper edge of the glazing and the upper rail of the sash in addition to providing a ventilation aperture.

The spacer members may be of any desired height in order to enable the upper and lower parts of the ventilator to be spaced apart, according to the quantity of air required, easily and cheaply. To further simplify assembly of the ventilator the spacer members are preferably slideable along the bars to the required position and also to this end the flap hinging may be shaped such that the flaps can be slid along the bars during assembly.

In a preferred embodiment, the operating member is connected to a shaft extending lengthwise of the bars and rotatably supported in the spacer members whereby the rotation of the shaft may be used to operate other flap operating members, particularly when the ventilator is mounted in long windows. The upper and lower bars of the ventilator are preferably extrusions of the same cross-section thereby simplifying assembly still further. The bars, flaps and spacer members may be made from extruded aluminum or other suitable materials, such as plastics materials.

In another preferred embodiment, the two bars are each constituted by inner and outer metal sections connected in spaced relation by a thermal insulating material, such as a plastics, constituting a thermal break between the inner and outer sections for example as described in my U.S. Pat. No. 3,908,313.

The invention also consists in a window assembly including and a kit of parts for constructing, any of the ventilators referred to hereinabove.

Embodiments of the invention will now be described with reference to the accompanying drawings in which:

FIG. 1 shows a partly cut-away perspective view of a ventilator mounted in a window sash, FIG. 2 is a diagrammatic inside front view of the ventilator and sash shown in FIG. 1 on a smaller scale, and FIG. 3 shows diagrammatically a cross-section through a modified ventilator mounted in a sash on a smaller scale.

Referring to FIGS. 1 and 2 there is shown a double glazing unit 1 and the upper rail 2 of a window sash within which the unit 1 is mounted. Between the upper edge 3 of the unit 1 and the rail 2 there is a ventilator including a lower bar 4 and an upper bar 5 which are held apart by spacer members 6 spaced at intervals along the bars, and of which two are located at opposite ends respectively of the bars as shown in FIG. 2. The spacer members are slidable during assembly of the ventilator along the bars 4 and 5 into the positions illustrated by virtue of joint parts 7, 8, 9 and 10 having a dovetail shape and which connect them to the bars. The spacer members may be secured to the bars simply by deforming the bars at their connections to the spacer members. A gasket 11 of resilient material, for example rubber, is positioned between the upper edge of the glass unit 1 and the lower bar 4 of the ventilator and the upper bar 5 of the ventilator is mounted upon the rail 2 by means of screws 13. The cross-sections of the bars 4 and 5 are the same and they may be cut by a user from a single length of the material, the holes for the screws 13 being drilled in the bar which is to act as the upper bar. Alternatively, the holes may be drilled in this part during manufacture, making it necessary for two different types of bar to be supplied for cutting by the user, one suitable for use as an upper and one as a lower bar. However, by employing some other form of fixing, for example by means of countersunk headed screws passing vertically through the base of the dovetail joint portion 9 into the rail 2, it is possible to supply a standard length, having fixing holes drilled in it in a place which, in use, is not normally visible, and which therefore may be used as either the upper or the lower bar.

Rotatably supported in the spacer members 6 is a shaft 14 to which a solid wheel 16 constituting a crank is connected. Links 17 and 18 are pivotally connected to both the wheel 16 and respective flaps 19 and 20 which are hinged upon the bars 4 and 5 by means of projections 21, 22 accommodated in longitudinally extending channels or grooves 23, 24 formed in the bars 4 and 5 and into which the projections are fitted by lengthwise sliding. Depending upon the length of the window optionally one or more further cranks 16 may be connected to the shaft 14 such as indicated at the left hand side of FIG. 2 and connected to the flaps so that rotation of the shaft will be transmitted thereto by all the cranks.

The link 17 is coupled to the flap 19 by means of a hinge member 25 having a threaded portion which extends through the flap and screws into a retaining member 26 which holds it in place. The member 26 also acts as an anchor for an operating cord 27 which hangs down from the inside of the ventilator.

Optionally, the wheel 16 is coupled to the shaft 14 by a simple spiral return spring 28. A cover, not shown, is provided, in practice, on the wheel 16 to cover the spring 28 and the pivot connections of the links 17, 18 on the wheel 16.

The flaps 19, 20 may be extruded with outwardly projecting side portions in the form of ribs, as illustrated cut-away at 30 on flap 19, extending along their length. These side portions provide longitudinal reinforcement and may conveniently act as an operating handle on the inner flap 19 and as a drip strip on the outer flap 20.

In the operation of the embodiment shown in FIG. 1, the spring 28 acts upon the wheel 16 to rotate it and the shaft in the clockwise direction, thereby to cause the flap 19 and 20 both to be rotated in the clockwise direction about their respective pivot points 21, 23 and 22, 24, as indicated by the arrows, through the links 17, 18. This action causes the flap 19 to close the aperture between the lower and upper bars 4 and 5 on the inner side of the ventilator and the flap 20 to close the aperture between the lower and upper bars 4 and 5 on the outer side of the ventilator.

When the operating cord 27 is pulled downwards in the direction indicated at 31, the wheel 16 is rotated in an anticlockwise direction against the spring 28 through the link 17, and the flap 19 is also directly rotated in an anticlockwise direction to cause the inner ventilator aperture to be opened. At the same time, the flap 20 is rotated, through the link 18, in an anticlockwise direction to cause the outer ventilator aperture to be opened.

In the particular embodiment, the ventilator is held open in a required position by anchoring the cord 27 on a suitable fixing. However, other types of mechanism controlling the opening of the ventilator, for example one similar to that used in a roller blind, or a friction controlled locating device in combination with an operating handle similar to that shown at 30, may be used.

The number of spacer members 6 may be varied according to the dimensions of the ventilator.

The arrangement of flaps provides protection against the weather on the outside when the ventilator is open and ensures that the air movements on the inside are at a high level thereby enabling ventilation to be provided to distant parts of a room in a controlled manner according to the degree of opening of the ventilator.

A radial flow fan having freely rotatable blades may be mounted in the ventilation aperture as shown in the diagrammatic section of FIG. 3 to control air flow through the ventilator. Blades 35 extend from a hollow shaft 36 having a sleeve bearing 37 which is freely rotatable on the shaft 14 of the arrangement shown in FIG. 1. The blades 35, which may be angled or bent as required, automatically provide a baffle between incoming and outgoing air and ensure that outgoing air is replaced by a similar amount of fresh incoming air thereby avoiding the replacement of outgoing air by air which is already within the building.

An insect screen of gauze, as indicated at 34, may easily be incorporated in the ventilator and be located in the female parts of the dovetail joints on the bars 4 and 5 between the spacer members.

Although particular embodiments of the invention have been described, it will be understood that modifications and variations may be made within the scope of the present invention as defined in the appended claims. For example, strengthening ribs may be incorporated on other parts than the flaps 19, 20, and the ventilator arrangement can be used to provide ventilation in other members than windows and with single glazing units, as required. It is also possible for the operating force to be applied directly to the crank wheel 16. The spacer members are conveniently made of blocks which are cast or cut from a length of extruded plastics material such as Nylon, though other materials can be used. Furthermore other operating assemblies than that provided by the crank wheel 16 and the links 17, 18 may be employed.

It will be seen that an easily assembled ventilator can be provided for almost any size of opening from standard parts and without the need to stock a variety of different sizes of ventilator. Furthermore, the ventilator may easily be accommodated in new or existing vindows either by employing glass of the correct size or by cutting the glass with a simple straight line cut. The ventilator provides a neat appearance, being virtually flush when closed, and provides an effective seal when not in use.

I claim:

1. A ventilator, primarily intended to be mounted within a window sash between the upper rail of the sash and the upper edge of glazing in the sash, said ventilator including (a) upper and lower bars of uniform cross-section, (b) a plurality of spacer members located between said bars at spaced intervals along the length of the bars to space the bars apart and defining with said bars at least one ventilation aperture extending from the inside to the outside of the ventilator, (c) said spacer members having parts shaped to interengage with the cross-sectional shape of the respective bars to connect the bars together in addition to spacing them apart, (d) a pair of flaps hinged to respective ones of said upper and lower bars each for swinging movement in one direction away from said at least one ventilation aperture to open the ventilator and in the reverse direction for swinging movement towards the bar other than that to which it is hinged to close the ventilator, (e) a shaft extending between and mounted in the spacer members, (f) crank means mounted on said shaft, and (g) means operatively connecting said crank means with said flaps for simultaneous hinging of the respective flaps in the directions to open and close the ventilator.

2. A ventilator as claimed in claim 1, wherein the flaps are hinged to said bars by means of interengaging grooves and projections extending lengthwise of the bars and flaps respectively whereby to permit the flaps to be slidably hingedly interengaged with the bars during assembly of the ventilator.

3. A ventilator as claimed in claim 1, wherein said bars are extrusions of the same cross-section.

4. A ventilator as claimed in claim 1, wherein the crank means comprises a plurality of crank members mounted on and rotatably connected to said shaft which is rotatably supported in said spacer members.

5. A ventilator as claimed in claim 1, including a fan freely rotatable about said shaft in the ventilation aperture.

6. A ventilator as claimed in claim 1, wherein the flaps each have an outwardly projecting portion serving as an operating handle on the inside of the ventilator and a drip strip on the outside of the ventilator.

7. For assembling a ventilator as claimed in claim 1, a set of components including (a) a length of bar material having a uniform cross-section defining a dovetail groove extending along one face thereof and an open circular chanel extending therealong to one side of said dovetail groove, (b) a length of spacer member material having a uniform cross section with dovetail projections complementary to said dovetail groove along opposite faces of said spacer material, and (c) a length of strip-like flap material having a uniform cross-section with an enlargement along one longitudinal edge thereof which is adapted to slide into the open circular channel in the bar material and form a hinge connection therebetween, and having a width approximating the dimension across the opposing dovetail proejections of the spacer member material.

8. A ventilator as claimed in claim 1, wherein the spacer members are connected to said bars by one of undercut grooves and projections on the spacer members interengaging with one of a complementary undercut projection and groove along a bar whereby to permit the spacer members to be slidably positioned along the upper and lower bars during assembly of the ventilator.

9. A ventilator as claimed in claim 8, wherein the flaps are hinged to said bars by means of interengaging grooves and projections extending lengthwise of the bars and flaps respectively whereby to permit the flaps to be slidably hingedly interengaged with the bars during assembly of the ventilator.

* * * * *